United States Patent [19]

Bentley

[11] 4,341,505

[45] Jul. 27, 1982

[54] SONIC PRESSURE WAVE PUMP FOR LOW PRODUCTION WELLS

[76] Inventor: Arthur P. Bentley, P.O. Box 1952, Roswell, N. Mex. 88201

[21] Appl. No.: 160,934

[22] Filed: Jun. 19, 1980

Related U.S. Application Data

[63] Continuation-in-part of Ser. No. 958,552, Nov. 8, 1978, Pat. No. 4,295,799.

[51] Int. Cl.[3] ..... F04F 7/00; F04B 9/10; F04B 35/02

[52] U.S. Cl. ..... 417/240; 417/378

[58] Field of Search ..... 417/240, 241, 378, 379

[56] References Cited

U.S. PATENT DOCUMENTS 1,222,601 4/1917 Campbell ..... 417/240
2,379,539 7/1945 Mercier ..... 417/240
3,838,945 10/1974 Moore ..... 417/378
4,295,799 10/1981 Bentley ..... 417/240

*Primary Examiner*—Richard E. Gluck
*Attorney, Agent, or Firm*—Herbert E. Haynes, Jr.

[57] ABSTRACT

A sonic pressure wave surface operated pump for use in pumping liquid from low production wells. The pump includes an aboveground generator which produces sonic pressure waves of special character in a liquid column. The sonic pressure waves are transmitted by the liquid column through a normally closed liquid discharge unit to a subterranean pumping assembly which is operated by the waves to draw the liquid into the pumping assembly and build the hydrostatic pressure thereof to a point where the liquid discharge unit will move to its open position which allows the sonic pressure waves which are reflected by the subterranean pumping assembly to carry the liquid to the surface.

14 Claims, 6 Drawing Figures

SONIC PRESSURE WAVE PUMP FOR LOW PRODUCTION WELLS

CROSS-REFERENCE TO RELATED APPLICATION

This application is a continuation-in-part of a copending U.S. patent application for SONIC PRESSURE WAVE SURFACE OPERATED PUMP, Ser. No. 958,552, filed on Nov. 8, 1978, now U.S. Pat. No. 4,295,799.

BACKGROUND OF THE INVENTION

1. Field of the Invention

This invention relates to pumps and more particularly to a sonic pressure wave pump which is particularly adapted for use in low production wells.

2. Description of the Prior Art

For many years, oil wells which are considered as low production wells, for example, in the range of from four to 10 barrels per day, have been capped in that the costs for pumping such small quantities have far exceeded the returns that could reasonably be expected. Even with the high costs of petroleum products today, pumping such small quantities is still not profitable due to the type of pump mechanisms in general use. The generally used pumps, sometimes referred to as "walking beam pumps", are very expensive from initial cost, operating expense and maintenance standpoints, and as a result, many low production wells remain capped. Another problem with most low production wells is the high gas content which in some instances, will prevent or at least impair, the operation of the walking beam pumps.

For many years now another basic approach in pumps has been proposed which involves imparting intermittent pressure waves on a column of liquid contained in pump tubing which extends from the subterranean source of the liquid to an above ground location. In general, the pressure waves are generated by an above ground mechanism which reciprocally impacts the column of liquid and, in addition, will cyclically open and close a liquid delivery port. Such impacting of the column of liquid produces pressure waves that are transmitted by the liquid to the down-hole pumping device such as a standing valve to impart a reciprocal movement thereto. The down-hole pumping device usually includes a plunger, or similar mechanism, which is biased upwardly by suitable springs and has a central passage formed axially therethrough with a one-way check valve located in the passage. When the hydraulic pressure waves move the plunger down against the spring bias, the check valve opens to admit the liquid being pumped into the passage. And the subsequent upstroke of the plunger closes the check valve and causes a general upward movement of the liquid column with the uppermost portion thereof discharging an amount of liquid, through the delivery port, with the amount being equal to the amount taken in by the down-hole pumping device.

Examples of pumping mechanisms which operate generally in the above described manner are fully disclosed in U.S. Pat. Nos. 2,379,539; 2,355,618; 2,428,460; 2,572,977; 2,751,848 and 3,277,381.

These prior art pumps critically depend on ideal adjustments of the input frequency relative to the length of the pump tubing in which the liquid column is contained. That is, resonant timing. Further, these prior art pumps are seriously limited as to their pumping capacity due to fluid friction, inertia of the liquid, and the like. The problems with resonant timing, frictional losses and the like have kept these prior art pumps from becoming commercially successful in general pumping applications, and they are not practical for use in low production wells due to the high gas content and low fluid flow rates in that such conditions render these pumps virtually inoperable.

Therefore, a need exists for a new and useful pump for use in low production wells which overcomes some of the problems and shortcomings of the prior art.

SUMMARY OF THE INVENTION

In accordance with the present invention, a new and improved sonic pressure wave surface operated pump is disclosed for use in pumping subterranean liquids, such as oil, from low production wells, and the pump may be provided with a gas separator means when such wells contain occluded gasses. The pump includes a surface located sonic pressure wave generator of special configuration which generates sonic pressure waves in a column of liquid which is coupled through a liquid discharge unit to a production tube which extends to the subterranean liquid source. A subterranean pumping assembly is mounted on the depending end of the production tube and is operated by the sonic pressure waves to admit the liquid to be pumped into the pumping assembly so that the reflected sonic pressure waves can carry the liquid to the surface where it is directed through the liquid discharge unit to the gas separator means and ultimately to a suitable liquid receiving facility.

The sonic pressure wave generator includes a vertically disposed cylinder in which the upper surface of the liquid column is maintained at a predetermined level. A piston is reciprocally mounted in the cylinder to cyclically impact the liquid column to produce the sonic pressure waves which are of special character due to the configuration of the liquid impacting face of the piston. The liquid impacting face of the piston is formed with a centrally located truncated conical recess, or cavity, which extends axially into the piston so as to communicate with a blind cylindrical bore formed axially in the piston. In this manner, the impacting face of the piston is of ring-like configuration.

Cyclic impacting of the liquid column by a piston configured as described above produces sonic pressure waves which move downwardly through the production tube along the inner walls thereof in a manner which is not fully understood, and operate the pump of the present invention with unexpectedly high production capabilities in view of the relatively low operating power consumption.

Since the pump of the present invention is intended for use in pumping liquids from low production wells, the liquid discharge unit and the subterranean pumping assembly are of special configuration.

The surface located liquid discharge unit is biased so that its liquid outlet port is normally closed and the sonic pressure waves are transmitted therethrough to the subterranean level. The liquid discharge unit will remain in this normal position until the subterranean pumping assembly builds up sufficient hydrostatic pressure to overcome the bias applied to the liquid discharge unit. When this occurs, the liquid discharge unit is moved to open its liquid outlet port and momentarily interrupt the transmission of the sonic pressure waves. In this state, the liquid will move through the outlet port of the liquid discharge unit partly due to its relieving of the built up hydrostatic pressure, and partly due to the sonic pressure waves which move upwardly through the center of the liquid column by virtue of their being reflected by the subterranean pumping assembly.

The subterranean pumping assembly includes a sonic intensifier/induction unit which receives the sonic pressure waves from the production tube, increases the velocity thereof and directs them through at least one counterbalancing means to a plunger means upon which the sonic pressure waves impinged to reciprocally operate the plunger. The sonic pressure waves are reflected upwardly from the top surface of the plunger and pass centrally through the production tube to the surface. The counterbalancing means are connected to the plunger means so that it is biased upwardly against a given head pressure of the liquid column, and additional head pressure counterbalancing units may be added as needed to the subterranean pumping assembly for deeper wells. The plunger mechanism is moved downwardly by the sonic pressure waves as mentioned above, and a check valve carried by the plunger is operated to admit liquid to the axial passage formed through the plunger means. A liquid intake unit including a check valve means is mounted on the lowermost end of the subterranean pumping assembly for intaking liquid from the underground source. Oscillatory movements of the plunger in response to the sonic pressure waves will charge the liquid intake unit with the liquid being pumped and upon completion of such charging the plunger check valve will open and admit this liquid under pressure into the axial passage formed through the plunger.

The sonic pressure wave pump of the present invention is unexpectedly efficient as hereinbefore mentioned, and this efficiency is believed to result from the special character of the sonic pressure waves, and exactly what happens is not clearly understood. It is known however, that the special configuration of the liquid impacting piston results in the sonic pressure waves moving downwardly along the inner walls of the production tubing in a manner which apparently does not apply any downwardly exerted forces on the liquid in the center of the production tube. The downwardly moving sonic pressure waves impinge on the plunger mechanism and are reflected upwardly in the center of the production tube and the liquid being pumped is carried upwardly by the reflected sonic pressure waves. It is believed that the sonic pressure waves which move downwardly along the inner walls of the production tube form a friction reducing membrane the nature of which is unknown.

Accordingly, it is an object of the present invention to provide a new and useful pump.

Another object of the present invention is to provide a new and useful sonic pressure wave surface operated pump.

Another object of the present invention is to provide a new and useful sonic pressure wave surface operated pump having a higher operating efficiency than other known pumps.

Another object of the present invention is to provide a new and improved sonic pressure wave surface operated pump which is especially configured for pumping liquid, such as oil, from low production wells.

Another object of the present invention is to provide a new and improved sonic pressure wave surface operated pump which is provided with a gas separator means which adapts the pump for operation in low production wells having a high gas content.

Another object of the present invention is to provide a new and improved sonic pressure wave surface operated pump of the above described character which includes an above ground sonic pressure wave generator which is coupled by a liquid discharge unit to a production tube which extends to the liquid source and supports a subterranean pumping assembly in liquid contact with the liquid to be pumped.

Another object of the present invention is to provide a new and useful sonic pressure wave surface operated pump of the above described character in which the sonic pressure wave generator includes an especially configured reciprocally operable piston which cyclically impacts a column of liquid to produce special sonic pressure waves which operates the pump of the present invention with unexpectedly high operating efficiencies.

Another object of the present invention is to provide a new and useful sonic pressure wave surface operated pump of the above described character wherein the liquid impacting piston has a truncated conical recess formed centrally in its liquid impacting face with that recess communicating with a blind cylindrical bore formed axially in the piston, with this piston configuration generating the sonic pressure waves so that they move downwardly along the inner walls of the production tube, operatingly impinge on the subterranean pumping assembly and are reflected back to the surface through the center of the production tube and thereby carry the pumped liquid to the surface.

Another object of the present invention is to provide a new and useful sonic pressure surface operated pump of the above described character wherein the liquid discharge unit is biased so as to hold the liquid outlet port thereof closed until sufficient hydrostatic pressure is produced by the subterranean pumping assembly to overcome the biasing force imposed on the liquid discharge unit.

Another object of the present invention is to provide a new and useful sonic pressure wave surface operated pump of the above described character wherein the subterranean pumping assembly is provided with at least one head pressure counterbalancing unit so that the pump will operate at a given depth and additional head pressure counterbalancing units may be added to incrementally increase the depth at which the pump will operate.

Another object of the present invention is to provide a new and useful sonic pressure wave surface operated pump wherein the subterranean pumping assembly is provided with a sonic intensifier/induction means which receives the sonic pressure waves from the production tube, increases the velocity thereof, and directs them through the head pressure counterbalancing unit to a plunger valve.

Another object of the present invention is to provide a new and useful sonic pressure wave surface operated pump of the above described character wherein the plunger valve is adapted to reciprocally move in response to the impinging sonic pressure waves to charge a liquid intake unit located on the bottom of the subterranean pumping assembly with liquid from the subterranean source, and admit this liquid to the axial passage formed through the plunger after the liquid intake unit is charged, and to allow this admitted liquid to be picked up by the reflected sonic pressure waves and carried to the surface through the center of the production tube.

The foregoing and other objects of the present invention, as well as the invention itself, may be more fully understood from the following description when read in conjunction with the accompanying drawings.

DESCRIPTION OF THE PREFERRED EMBODIMENT

Figure 1:
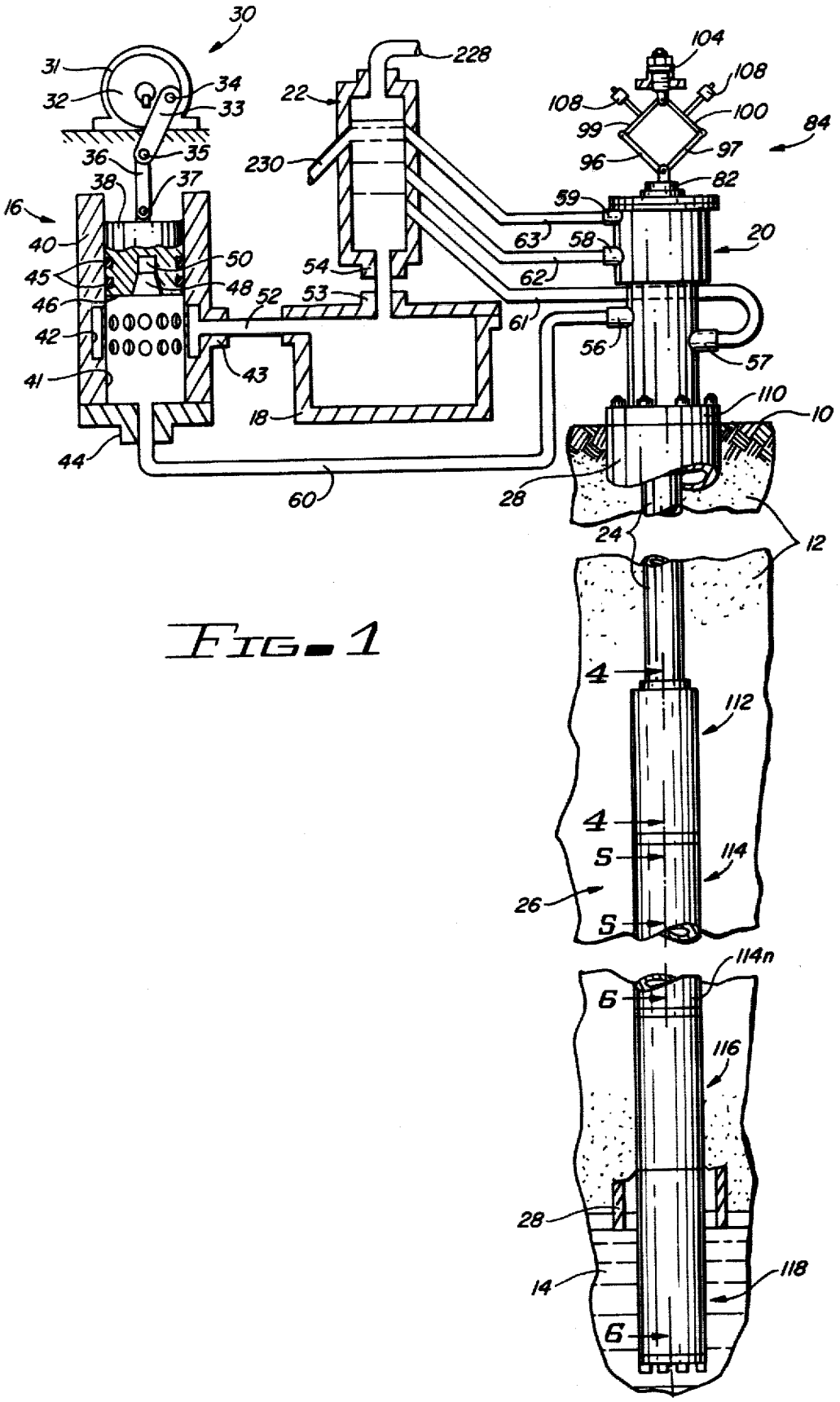
FIG. 1 is a vertical sectional view taken through a ground formation and illustrating the sonic pressure wave surface operated pump of the present invention within that ground formation.

Referring more particularly to the drawings, FIG. 1 illustrates a ground formation having a surface level 10, an underground portion 12 in which a liquid 14, such as oil, is located. The illustrated ground formation is intended to be indicative of a low production well, i.e., one which is capable of producing say, about four to 10 barrels of liquid per day. The sonic pressure wave surface operated pump of the present invention is seen to be located in the ground formation in a conventional manner, and includes a sonic pressure wave generator 16, a liquid reservoir 18, a liquid discharge unit 20 and a gas separator 22 all of which are located aboveground. A metallic production tube 24 depends from the liquid discharge unit 20 into the underground portion 12 of the earth formation and a subterranean pumping assembly 26 is mounted on the depending end of the production tube so as to be in communication with the liquid 14.

It will be noted that in accordance with standard practices, particularly in the oil well art, the bore formed in ground formation is lined with a well casing 28.

A drive means 30, which may be any of several well known mechanisms, is shown for completeness of the disclosure as including an electric motor 31 which rotatably drives a flywheel 32 that is carried on the motor's output shaft. A crank arm 33 is connected on one of its ends by a pivot pin 34 eccentrically mounted on the flywheel 32 and has its other end connected by a similar pin 35 to a connecting rod 36 which is in turn connected by a suitable wrist pin 37 to a piston 38 of the sonic pressure wave generator 16. In this manner, the drive means 30 which is a rotatably driven mechanism, will supply reciprocal movement to the piston 38 of the sonic pressure wave generator 16.

The sonic pressure wave generator 16 includes a vertically disposed cylinder 40 having an axial bore 41 formed therein, and having an annular groove 42 formed in the bore. A first port 43 extends laterally from the cylinder 40 and is disposed thereon so that it opens into the annular groove 42, and a second port 44 extends axially from the bottom of the cylinder. As will hereinafter be described, the first and second ports 43 and 44, respectively, provide a predetermined level of liquid (not shown) within the bore 41 of the cylinder 40.

The piston 38 is reciprocally driven in the bore of the cylinder 40 by the drive means 30 as hereinbefore described, and will cyclically impact the liquid 14 to produce sonic pressure waves in the liquid. The piston 38 is an elongated cylindrical structure having the usual annular seals 45. The lower liquid impacting face 46 of the piston 38 has a truncated conical cavity or recess 48 formed axially therein with the upper end of that cavity being in communication with a blind cylindrical bore or socket 50 which is also formed axially in the piston. Thus, the liquid impacting face 46 of the piston 38 is of ring-like configuration.

The first port 43 of the sonic pressure wave generator 16 is coupled by a conduit 52 to the liquid reservoir 18 which may be of any suitable tank-like configuration. The liquid reservoir 18 is provided with a port 53 which extends upwardly therefrom and is coupled to the bottom port 54 of the gas separator unit 22. The gas separator unit 22 is an elongated tubular structure, the operation of which will hereinafter be described.

The liquid discharge unit 20 is provided with an energy input port 56, an energy bypass port 57, a liquid outlet port 58 and a gas bleed-off port 59. The energy input port 56 is coupled by a suitable conduit 60 to the second port 44 of the sonic pressure wave generator 16. The energy bypass port 57, the liquid output port 58 and the gas bleed-off port 59 are coupled by conduits 61, 62 and 63, respectively, to the gas separator unit 22.

With the various components of the pump of the present invention interconnected in the above described manner, and the pump is primed, the liquid 14 will extend upwardly from the subterranean source in a column (not shown), and will fill the liquid discharge unit 20, the gas separator 22 and the liquid reservoir 18. Thus, by means of the conduits 52 and 60, the sonic pressure wave generator 16 is provided with the beforementioned given liquid level therein and that liquid is in communication with the liquid contained in the liquid discharge unit 20.

Figure 2:
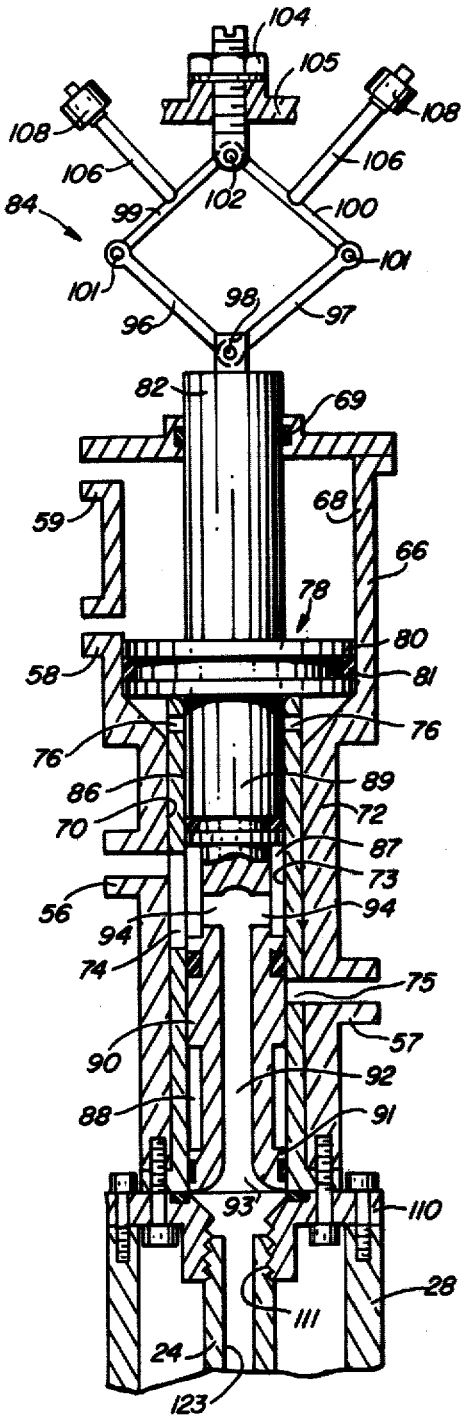
FIG. 2 is an enlarged sectional view of the liquid discharge unit of the present invention illustrating a first, or energy input, position thereof.
Figure 3:
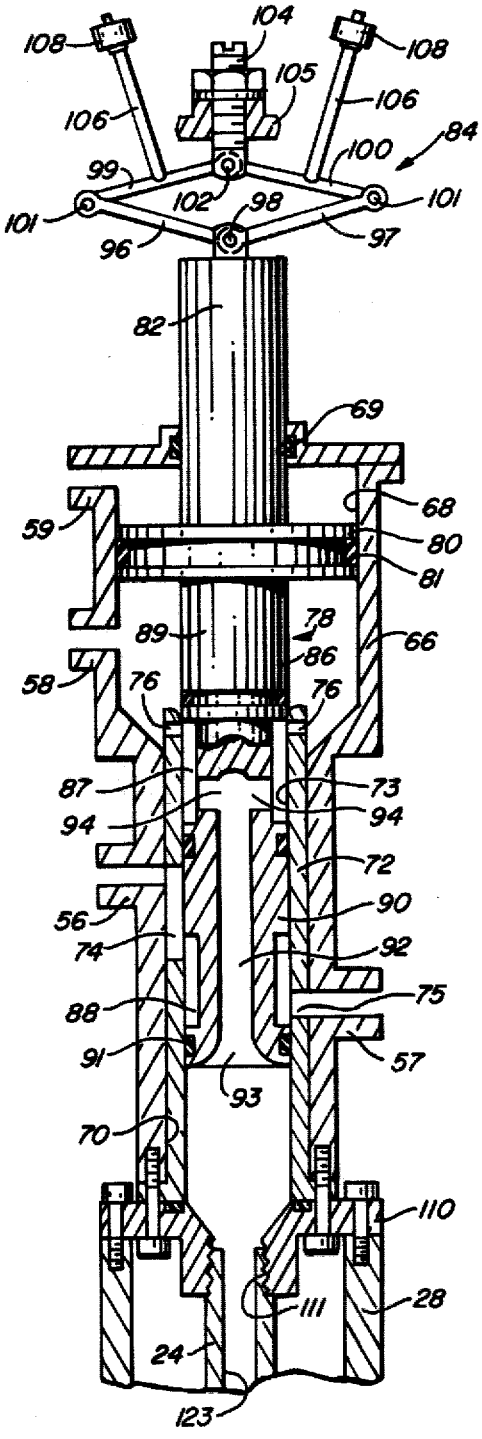
FIG. 3 is a sectional view similar to FIG. 2 showing the liquid discharge unit in a second, or liquid output, position thereof.

Referring now to FIGS. 2 and 3 wherein the liquid discharge unit 20 is shown in detail. The unit 20 includes a housing 66 having a cylindrical bore 68 formed in the upper end thereof, an axial port 69 formed through the top of the housing, and having a reduced diameter bore 70 extending axially downwardly therefrom through the housing. A sleeve 72 having an axial bore 73 formed therethrough, is fixedly mounted in the reduced diameter bore 70 of the housing 66 and has a first lateral slot 74 which is disposed to align with the energy input port 56 of the housing. In this manner, the energy input port 56 is in communication with the bore 73 of the sleeve. A second lateral slot 75 is formed through the side of the sleeve 72 and is disposed to align with the energy bypass port 57 of the housing 66 so that the bypass port 57 is also in communication with the bore 73 of the sleeve. The upper end of the sleeve 72 extends upwardly from the reduced diameter bore 70 of the housing 66 a short distance into the cylindrical bore 68 thereof, and the upper protruding end of the sleeve is provided with radial ports 76 which extend laterally from the bore 73 of the sleeve and open into the lower end of the cylindrical bore 68.

A slide valve 78 is axially movably mounted in the housing 66 and is configured with a piston portion 80 having a suitable annular seal 81 which is in sealing engagement with the walls that define the cylindrical bore 68 of the housing 66. A cylindrical spool 82 extends axially upwardly from the piston 80 through the axial port 69 of the housing 66 for connection to a biasing means 84 as will hereinafter be described in detail. A spool valve body 86 depends axially from the piston portion 80 and is disposed in the bore 73 of the sleeve 72. The spool valve body 86 is formed with an axially spaced pair of annular grooves 87 and 88, with the upper groove 87 separating a top land area 89 and an intermediate land area 90, and the lower groove 88 separating the intermediate land area 90 from the bottom land area 91. An axial passage 92 is formed in the spool valve body 86 and is provided with an open bottom 93 and radial ports 94 which extend laterally from the top of the passage so as to open into the upper annular groove 87.

The biasing means may be in the form of a conventional compression spring (not shown) which exerts a biasing force on the slide valve 78. However, due to the smooth operation and finite adjustment capabilities of the biasing means 84, which is best seen in FIGS. 2 and 3, the illustrated apparatus is preferred.

The preferred biasing means 84 is formed from the well known four-bar linkage type of mechanism which operates in parallelogram action to exert a downwardly directed force on the slide valve 78. The two lower bars 96 and 97 are pivotably connected to each other and to the top of the upwardly extending spool 82 by a suitable pivot pin 98. The two top bars 99 and 100 are connected to the extending ends of the lower bars 96 and 97 by pivot pins 100 and are connected to each other by a pivot pin 102. The pivot pin 102 is also connected to the depending end of an adjustment means 104 in the illustrated form of a screw threadingly carried in a suitable anchoring means 105. Each of the upper bars 99 and 100 have a rod 106 extending normally therefrom, and each of these rods has a weight 108 supportingly carried on the extending end thereof. This four-bar linkage arrangement in conjunction with the weights 108 will exert an adjustably determined downwardly directed force on the slide valve 78 and thus, bias it to its first, or normal, position shown in FIG. 2, and the slide valve 78 is movable, as will hereinafter be described, against the bias applied by the means 84, to its second position shown in FIG. 3.

As shown in FIGS. 2 and 3, an adapter plate 110 is affixed to the depending end of the liquid discharge unit 20 and is also affixed to the top of the well casing 28. The adapter plate 110 has a threaded bore 111 formed axially therethrough and the upper end of the production tube 24 is threadingly carried therein.

As hereinbefore mentioned, the production tube 24 extends into the ground formation and the subterranean pumping assembly 26 is mounted on the depending end thereof. The subterranean pumping assembly 26, as shown in FIG. 1, includes a sonic intensified/induction unit 112, at least one head pressure counterbalancing unit 114, an underground operating mechanism 116 and a liquid intake unit 118.

Figure 4:
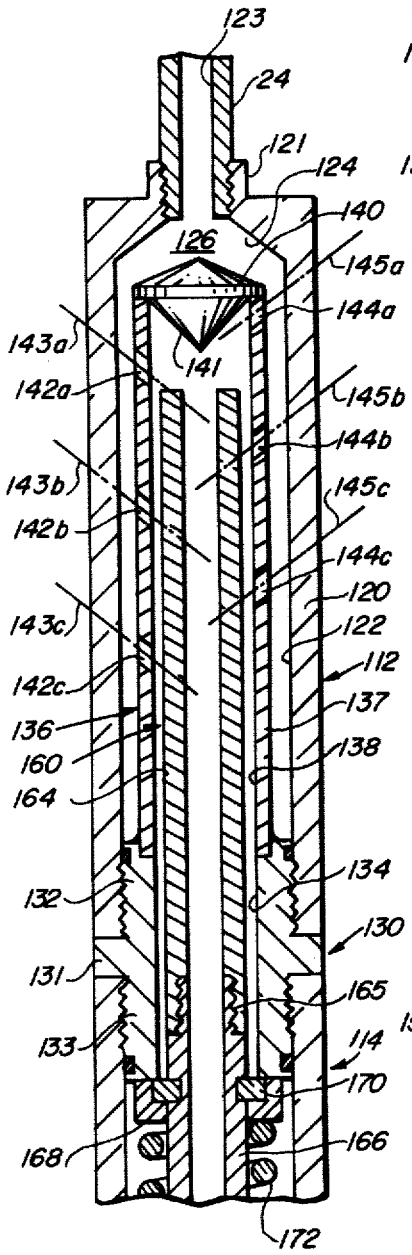
FIG. 4 is an enlarged sectional view taken along the line 4—4 of FIG. 1.

FIG. 4 illustrates the sonic intensifier/induction unit 112 as including an elongated cylindrical housing 120 which is preferably so configured due to the ease of lowering such a housing down through the well casing 28 (FIG. 1). The housing 120 has an internally threaded boss 121 formed on its upper end for threaded attachment to the depending end of the production tube 24 and has an axial bore 122 formed therethrough. The bore 122 of the housing 120 is of larger diameter than the bore 123 of the production tube 24, and is in axial communication therewith. The transition between the bores 122 and 123 is special in that this transition is accomplished by a truncated conical surface 124 which, in conjunction with the cylindrical bore 122 defines a sonic intensifier chamber 126. The sonic pressure waves, which are produced in the sonic pressure wave generator 16, and transmitted in the liquid column (not shown) through the liquid discharge unit 20 and move downwardly through the production tube 24 are received in the sonic intensifier chamber 126 as they emerge from the production tube and those waves are increased in velocity within the chamber 126.

The cylindrical housing 120 is internally threaded at its depending end and has a special nipple 130 mounted therein. The nipple 130 has the usual centrally disposed annular flange 131, upwardly extending threaded boss 132, downwardly extending threaded boss 133 and an axial passage 134. A sonic pressure wave inductor 136 is mounted on the upwardly extending threaded boss 132 of the nipple 130, such as by welding, so as to be upstanding therefrom within the bore 122 of the housing 120. The inductor 136 serves two purposes; first, to prevent downward migration of foreign matter which may have been inadvertently introduced into the mechanism, and secondly, to introduce the downwardly moving sonic pressure waves into the below mounted portions of the subterranean pumping assembly 26.

The sonic pressure wave inductor 136 includes an elongated tubular body 137 having a bore 138, and a head 140 of special configuration on its upper end. The special head 140 is seen to include an inverted cone 141 which depends axially into the bore 138 of the body 137. A spaced vertically aligned plurality of apertures **142*a*, 142*b* and 142*c* are formed through one side of the tubular body 137, and a similar plurality of apertures 144*a*, 144*b* and 144*c*** are spacedly arranged in vertical alignment on the diametrically opposed side of the tubular body.

Each of the apertures **142*a*, 142*b* and 142*c* lie on downwardly and inwardly sloping axes which are indicated at 143*a*, 143*b* and 143*c*, respectively. As seen the axes 143*a*, 143*b* and 143*c* are parallel with respect to each other and form a non-critical angle of about 45° from the vertical. Similarly, each of the apertures 144*a*, 144*b* and 144*c* lie on downwardly and inwardly sloping axes which are indicated at 145*a*, 145*b* and 145*c*, respectively. The axes 145*a*, 145*b* and 145*c* are parallel with respect to each other and form a non-critical angle of about 45° from the vertical, and since the apertures 144*a*, 144*b* and 144*c* are on the diametrically opposed side of the body 137 their axes 145*a*, 145*b* and 145*c* slope oppositely from the axes of the apertures 142*a*, 142*b* and 142*c*. As seen, the apertures 142*a*, 142*b* and 142*c* are vertically and downwardly offset from the apertures 144*a*, 144*b* and 144*c* so that their axes intersect at locations which are laterally offset from the vertical axis of the housing 137. It will also be noted that the depending end of the inverted cone 141 falls on the axis 145*a* of the aperture 144*a***.

The exact effect that the above described configuration of the sonic pressure wave inductor 136 has on the downwardly moving sonic pressure waves, and the liquid which is subsequently carried to the surface on the reflected pressure waves is unknown. It is known however, that if this configuration is excessively modified, the efficiency of the pump will fall off and if the modification is excessive, the pump will cease to function altogether. For example, the exact angle of the axes 143*a*, 143*b* and 143*c* and 145*a*, 145*b* and 145*c* need not be exactly 45°, however, the efficiency of the pump will suffer if the range of say, 40° to 50° is exceeded in either direction. Further, the depending end of the cone 141 may be lowered so that it crosses the axis 145*a* instead of falling thereon. This does not seem to impair the efficiency of the pump, but if the depending end of the cone 141 is raised so that it does not at least fall on the axis 145*a* the pump's efficiency will fall off drastically.

Apparently, the above described configuration relationships of the sonic pressure wave inductor 136 corresponds with the travel paths of the donwardly moving sonic pressure waves and the subsequent upward movement of the liquid carried by the reflected sonic pressure waves.

As will hereinafter be described, the underground operating mechanism 116 must be biased upwardly an amount which corresponds approximately to the head pressure exerted by the liquid column (not shown) contained in the pump of the present invention.

Therefore, the subterranean pumping assembly 26 includes at least one head pressure counterbalancing unit 114. The head pressure counterbalancing unit 114 includes an elongated cylindrical housing 150 having an axial bore 152 extending therethrough, and having internal threads formed in the upper end of the housing by which it is threadingly connected to the downwardly extending boss 133 of the special nipple 130. The housing 150 is also formed with internal threads 153 at its lower end for threaded attachment to the upper threaded boss 154 of a nipple 155 which has the usual annular flange 156, threaded lower boss 157 and axial passage 158.

An elongated tube assembly, which is indicated generally by the numeral 160, is axially disposed in the subterranean pumping assembly 26, and as will hereinafter be described, the tube assembly 160 is axially movable, has a bore 162, and is formed of a plurality of tube segments, the exact number of which is determined by the head pressure.

The elongated tube assembly 160 includes a top tube segment 164 which is coaxially disposed within the bore 138 of the sonic pressure wave inductor 136, and is threadingly attached as at 165 to an extender tube segment 166. The extender tube segment 166 is coaxially disposed in the bore 152 of the housing 150 of the head pressure counterbalancing unit 114, and an annular ring 168 is fixedly secured adjacent the upper end of the extender tube segment 166 by a suitable keeper 170. A compression spring 172 is interposed between the downwardly facing surface of the annular ring 168 and the flattened top end of the upper threaded boss 154 of the nipple 155. The compression spring 172 is designed to counterbalance a given head pressure and does so, as will become apparent as this description progresses, by exerting an upwardly directed biasing force on the elongated tube assembly 160. The spring 172, of course, has physical limitations and thus, when the head pressure of a particular installation exceeds the counterbalancing capabilities of the spring 172, additional head pressure counterbalancing units 114*a*–114*n* (FIGS. 5 and 6) may be added on an as needed basis.

It will be understood that each of the additional head pressure counterbalancing units 114*a*–114*n* are identical to the above described counterbalancing unit 114 and thus, no detailed discussion thereof is deemed necessary.

Figure 6:
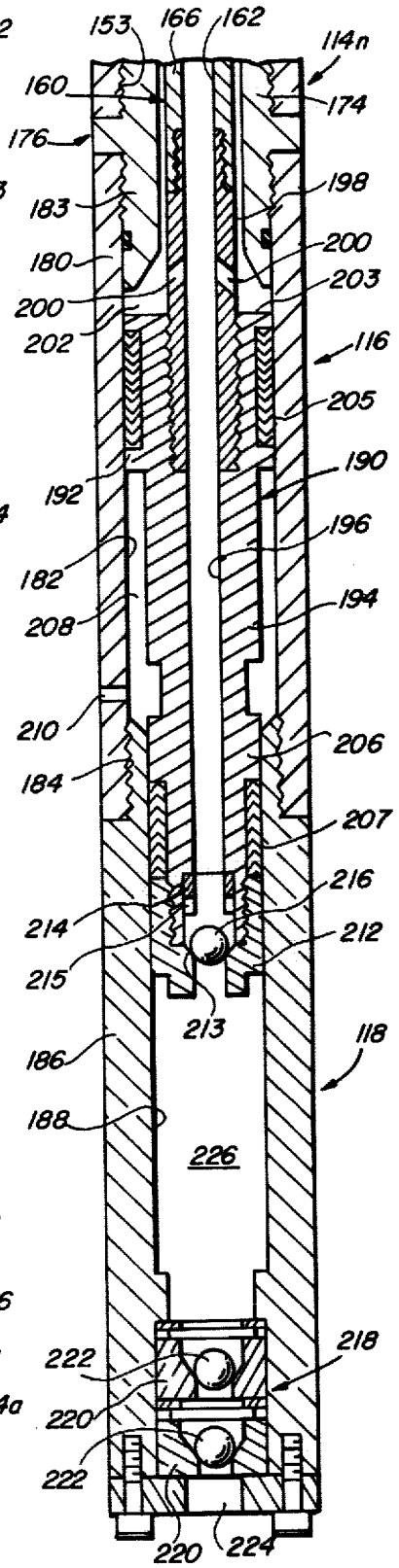
FIG. 6 is an enlarged sectional view taken along the line 6—6 of FIG. 1.

As seen in FIG. 6, the lowermost head pressure counterbalancing unit 114*n* has the internal threads 153, which are formed in the lower end of its cylindrical housing 150, threadingly attached to the upper threaded boss 174 of a nipple 176 which is carried in the upper end of the underground operating mechanism 116.

The underground operating mechanism 116 includes a cylindrical housing 180 having a bore 182, with the housing internally threaded at its upper end for attachment to the lower threaded boss 183 of the nipple 176, and has internal threads 184 formed in the lower end thereof.

The liquid intake unit 118, as will hereinafter be described in detail, includes a cylindrical housing 186 having a bore 188, and is threadingly attached to the lower internal threads 184 formed in the bottom of the underground operating mechanism's housing 180.

A plunger 190 is reciprocally mounted in the bore 182 of the housing 180 and is formed with a head portion 192 from which a reduced diameter spool valve body 194 depends. The plunger 190 is formed with an axial bore 196 extending therethrough, and internal threads are provided in the upper end of the axial bore for attaching the plunger to the lowermost tube segment 198 of the elongated tube assembly 160. The lower tube segment 198 is threadingly attached to the depending end of the extender tube segment 166 of the head pressure counterbalancing unit 114*n*, and is formed with radial ports 200 so that the liquid of the column (not shown) is contained in the chamber 202 above the top surface 203 of the head portion 192 of the plunger 190, and since the liquid is present in this chamber, the downwardly moving sonic pressure waves will also be admitted through the ports 200.

Figure 5:
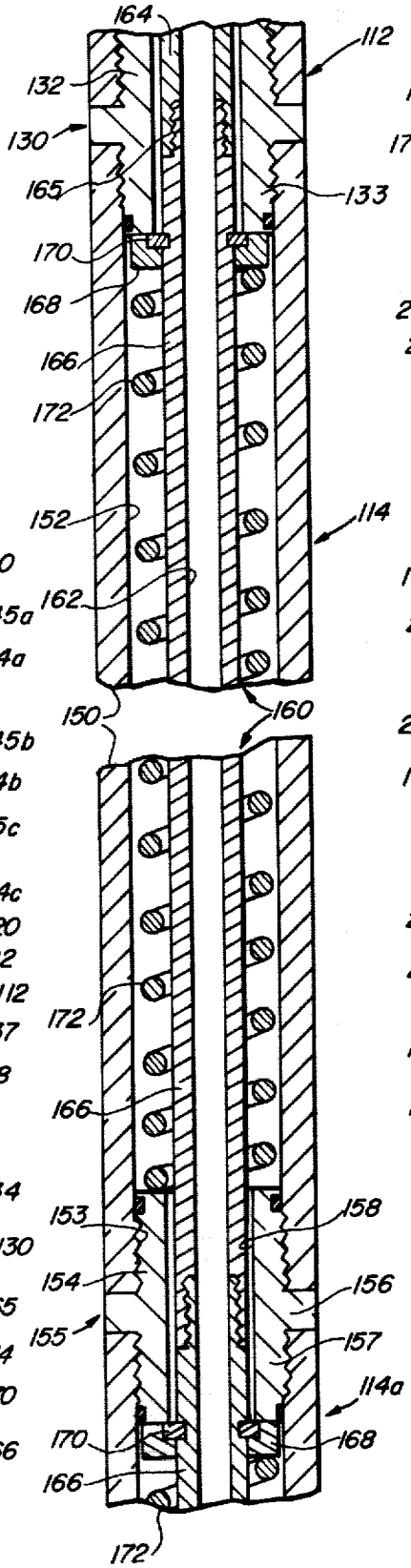
FIG. 5 is an enlarged sectional view taken along the line 5—5 of FIG. 1.

The purpose for the head pressure counterbalancing unit(s) 114 will now be apparent upon considering that the head pressure of the liquid column (not shown) will exert a downwardly directed force on the top surface 203 of the head portion 192 of the plunger 190, and the spring(s) 172, FIG. 5, counterbalance that head pressure.

The head portion 192 of the plunger 190 is reciprocally movable in the bore 182 of the housing 180 as hereinbefore mentioned, and is provided with a suitable seal 205. The depending spool valve body 194 has a bottom land area 206 which is reciprocally movable in the bore 188 of the liquid intake housing 186 and the lower land 206 is provided with a suitable seal 207. As shown, the area between the head portion 192 and the bottom land 206 defines a chamber 208 below the head portion 92 within the bore 182 of the housing 180. That chamber 208 is a gas relief chamber which vents gas, which may leak into the chamber, through a relief port 210 formed in the side of the housing.

The lower end of the plunger 190 has a check valve body 212 threadingly mounted thereon with a valve seat 213 formed in the axial passage of the valve body. A spacer sleeve 214, having slots 215 formed in the depending end thereof, is fixedly mounted at the top of the axial passage of the check valve body 212. A ball valve 216 is mounted in the check valve body 212 and will be normally in seated engagement with the valve seat 213 to yieldably close the passage through the check valve body 212. The ball valve 216 will thus prevent the downward flow of the liquid column in the pump of the present invention but will allow upward flow of the liquid 14 (FIG. 1). The slotted spacer sleeve 214 will prevent the ball valve 216 from interfering with the upward flow of the liquid 14.

As hereinbefore mentioned, the liquid intake unit 118 includes the cylindrical housing 186 having the bore 188 formed therein. The lower end of the bore 188 has check valve means 218 mounted therein in the illustrated form of an axially aligned pair of check valve bodies 220 each of which has a ball valve 222 mounted therein so as to normally close the liquid inlet port 224 provided in the bottom end of the liquid intake housing 186. The bore 188 of the housing 186 provides the liquid intake unit 118 with a liquid charging chamber 226 into which the liquid 14 is movable through the check valve means 218, with the check valve means preventing reverse liquid flow.

Operation

As hereinbefore mentioned, exactly what occurs in the sonic pressure wave pump of the present invention is not clearly understood. However, extensive testing and experimentation have shown that the pump has unexpectedly high protection capabilities in view of the relatively low power coonsumption. Those tests and experiments lead me to believe that the pump operates in accordance with the following.

Cyclic impacting of the liquid column by the piston 38 of the generator 16 produces sonic pressure waves in the liquid column, and those pressure waves move through the liquid discharge unit 20, through the production tube 24 to the subterranean pumping assembly 26. Due to the special configuration of the liquid impacting face 46 of the piston 38, the sonic pressure waves appear to move downwardly through the production tube 24 along the inner walls which define the bore 123 thereof without exerting any appreciable downwardly exerted force on the central liquid core in the tube 24. It appears that the sonic pressure waves travel in a similar manner from the generator 116 through the liquid discharge unit 20 on their way to the production tube 24.

When the sonic pressure waves enter into the chamber 202 above the head portion of the plunger 190, they drive the plunger downwardly which causes partial evacuation of the contents of the liquid charging chamber 226 upwardly through the check valve body 212. At the commencement of pumping operations, the contents of the chamber 226 will be mostly gaseous in nature, and possibly some liquid will seep into that chamber from subterranean liquid source due to differential pressures. When the plunger 190 returns to its normal position a rarification will exist in the chamber 226 and the liquid 14 will be drawn into that chamber.

Since the pump of the present invention is designed for use in low production wells, it will take several oscillations of the plunger 190 to completely charge the chamber 226. When the chamber 226 is fully charged, the next downstroke of the plunger will admit the liquid 14 to the axial passage 196 of the plunger. The liquid so admitted into the passage will be under pressure due to the chamber charging operation.

The sonic pressure waves which move downwardly through the production tube 24 impinge on the top surface of the plunger 190 and are reflected back through the ports 200 into the central core of liquid in the subterranean pumping assembly 26 and more upwardly through the central core of the production tube 24, and the liquid admitted to the plunger passage 196 is carried with those reflected sonic pressure waves.

The reason for the apparent ease with which the reflected sonic pressure waves carry the liquid to the surface is the main thing which is not understood in the operation of the pump of the present invention. It is felt that the downwardly moving sonic pressure waves form some sort of a membrane which reduces the friction which would normally exist, and thus allows the central liquid core to move upwardly in a frictionless, or at least a reduced friction, manner.

The nature of the sonic pressure waves is unknown as hereinbefore noted. However, it is known that they are sonic in nature due to the noise which radiates from all points along the production tube 24 during pumping operation. It is also known that the sonic pressure waves have some sort of electric characteristic. This was discovered during a test when a portion of the metallic production tube 24 was replaced with a nonmetallic, nonconductive portion. Including the nonconductive section of production tube completely halted the operation of the pump, and normal operation resumed only when the nonconductive section of pipe was replaced with a metallic section.

When the upwardly central liquid core reaches the liquid discharge unit 20, it is directed through the axial passage 92 and radial ports 94 of the slide valve 78 and exerts an upwardly directed force on the bottom surface of the top land area 89 and will move the slide valve 78 from its first position shown in FIG. 2 to its second position shown in FIG. 3. The liquid then enters the portion of the bore 68 which is below the piston 80 and will exit the housing 66 through the liquid outlet port 58 which opens when the slide valve 78 moves to its second position.

When the liquid exits the housing 66 in the manner described, the biasing means 84 returns the slide valve to its first, or normal position. Due to the low production wall, there will always be several cyclic impacts of the liquid by the sonic pressure wave generator 16 for each movement of the slide valve 78 to its liquid discharging second position. the number of cyclic impacts required to completely charge the chamber 236 will be determined by the production capability of the particular well.

It will be noted that when the slide valve 78 is moved to its second position, the sonic pressure waves moving through the liquid discharge unit 20 toward the production tube 24 will be momentarily bypassed by means of the spool valve body 86 being positioned so that the energy input port 56 is in direct communication with the energy bypass port 57.

Since low production wells almost invariably have a high gas content, the liquid exiting the outlet port 58 of the liquid discharge unit 20 is directed by the conduit 62 to the gas separator unit 22. As seen in FIG. 1, the energy bypass port 57 and the gas bleed-off port 59 located at the upper end of the housing 66 to trap gas leakage past the piston 80, are also connected to the gas separator 22 by the conduit 61 and 63, respectively. In this manner, all the liquid and gas passing upwardly through the production tube 24 will be directed into the gas separator unit 22.

The occluded gas will bubble to the surface of the liquid contained in the gas separator unit 22 and will exit the unit 22 through a suitable gas discharge pipe 228. The liquid will flow under the influence of gravity from a liquid overflow pipe 230 which is provided on the gas separator unit 22, and from there the liquid is directed to a suitable liquid receiving facility (not shown).

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A sonic pressure wave surface operated pump for use in pumping liquid from low production wells and having a column of liquid therein, said pump comprising:

(a) a sonic pressure wave generator having a reciprocally operable piston for cyclically impacting the column of liquid;

(b) a metallic production tube coupled to said generator and extending downwardly toward the liquid to be pumped;

(c) said piston of said generator having a central recess formed in its liquid impacting face for generating the sonic pressure waves which move downwardly along the inner walls of said production tube;

(d) a liquid discharge unit interposed between said generator and said production tube and having a liquid output port, said liquid discharge unit having means responsive to an increase in hydrostatic pressure in the liquid column for movement form a first position in which said output port is closed and a second position in which said output port is open;

(e) biasing means for yieldingly urging said liquid discharge unit to its first state; and (f) a subterranean pumping assembly on the depending end of said production tube and in communication with the liquid to be pumped, said assembly having means for impingly receiving the downwardly moving sonic pressure waves and reflecting them upwardly through the center of said production tube and responding to the impinging sonic pressure waves by intaking the liquid to be pumped and building its hydrostatic pressure to a point where it will move said liquid discharge unit to its second position to allow the reflected sonic pressure waves to carry the intaken liquid upwardly therewith.

2. A sonic pressure wave surface operated pump as claimed in claim 1 wherein the central recess formed in the liquid impacting face of the piston of said sonic pressure wave generator is of trucated conical configuration.

3. A sonic pressure wave surface operated pump as claim in claim 1 wherein the central recess formed in the liquid impacting face of the piston of said sonic pressure wave generator is of truncated conical configuration which communicates with a blind cylindrical bore formed axially in said piston.

4. A sonic pressure wave surface operated pump as claimed in claim 1 wherein said biasing means is adjustable.

5. A sonic pressure wave surface operated pump as claimed in claim 1 and further comprising a gas separator means coupled to receive the pumped liquid from the liquid output port of said liquid discharge unit for separating the occluded gas from the pumped liquid.

6. A sonic pressure wave surface operated pump as claimed in claim 1 wherein said liquid discharge unit comprises:

(a) a housing having a bore formed therein, said housing mounted at the top of said production tube so that the bore of said housing is in communication with the bore of said production tube, said housing having said liquid output port and an energy input port which is connected to receive the sonic pressure waves from said sonic pressure wave generator; and (b) said means responsive to an increase in the hydrostatic pressure includes a slide valve reciprocally movable in the bore of said housing from the first position in which said energy input port is in communication with the bore of said production tube and the liquid output port is closed and the second position in which the liquid output port is in communication with the bore of said production tube.

7. A sonic pressure wave surface operated pump as claimed in claim 6 and further comprising an energy bypass port which is in communication with the energy input port when said slide valve is in the second position.

8. A sonic pressure wave surface operated pump as claimed in claim 7 and further comprising a gas bleed off port formed in said housing for bleeding off any gas which may leak past said slide valve.

9. A sonic pressure wave surface operated pump as claimed in claim 8 and further comprising a gas separator means coupled to the liquid output port, the energy bypass port and the gas bleed-off port of said liquid discharge unit to receive the liquid being pumped and any occluded gas for separation of the gas from the liquid being pumped.

10. A sonic pressure wave surface operated pump as claimed in claim 1 wherein said subterranean pumping assembly comprises:

(a) an operating mechanism having a reciprocally movable plunger with a head portion for supporting the liquid column and impingingly receiving the downwardly moving sonic pressure waves and responding by moving downwardly and reflecting the sonic pressure waves upwardly through the center of said production tube, the plunger having a valve body depending from its head portion and having an axial passage;

(b) check valve means in the axial passage of the plunger of said operating mechanism which allows liquid flow upwardly thereinto;

(c) means for biasing the plunger of said operating mechanism upwardly;

(d) a liquid intake unit on the depending end of said operating mechanism and defining a liquid charging chamber which is in communication with the liquid to be pumped;

(e) check valve means in said liquid intake unit which allows liquid flow into the liquid charging chamber thereof; and (f) the valve body of the plunger of said operating mechanism being reciprocally movable in the liquid charging chamber of said liquid intake unit whereby a downstroke of the plunger will force the contents of the liquid charging chamber into the axial passage of the plunger and an upstroke of the plunger will draw the liquid to be pumped into the liquid charging chamber of said liquid intake unit.

11. A sonic pressure wave surface operated pump as claimed in claim 10 wherein said means for biasing the plunger of said operating mechanism including at least one head pressure counterbalancing unit which biases the plunger upwardly with an amount of force equal to a specific amount of the head pressure exerted by the liquid column.

12. A sonic pressure wave surface operated pump as claimed in claim 10 wherein said means for biasing the plunger of said operating mechanism comprises a plurality of head pressure counterbalancing units each of which is capable of exerting an amount of biasing force equal to a predetermined amount of the head pressure exerted by the liquid column, said plurality of head pressure counterbalancing units selectively assemblable in said subterranean pumping assembly for incrementally increasing the bias on the plunger of said operating mechanism.

13. A sonic pressure wave surface operated pump as claimed in claim 10 and further comprising a sonic pressure wave intensifier/induction unit connected to the depending end of said production tube for receiving the downwardly moving sonic pressure waves, said intensifier/induction unit having means for increasing the velocity of the downwardly moving sonic pressure waves and directing them to said operating mechanism.

14. A sonic pressure wave surface operated pump as claimed in claim 13 wherein said sonic pressure wave intensifier/inductor unit comprises:

(a) a housing mounted on the depending end of said production tube and having a bore of larger diameter than the bore of said production tube and having a truncated conical surface at the upper end of said bore which forms the transition between the bore of said production tube and the bore of said housing;

(b) an elongated tubular body having a smaller diameter than the bore of said housing and having an axially extending bore, said body mounted in said housing to close the bore of said housing at the lower end thereof and disposed to extend coaxially upwardly in the bore of said housing;

(c) a head on the upper end of said body for closing the bore thereof, said head including an inverted conical projection extending axially downwardly into the bore of said body;

(d) a first plurality of vertically aligned apertures formed in one side of said tubular body and each lying on an axis which slopes inwardly and downwardly into the bore of said body;

(e) a second plurality of vertically aligned apertures formed on the diametrically opposed side of said tubular body and each lying on an axis which slopes inwardly and downwardly into the bore of said body; and (f) said first plurality of apertures upwardly disposed with respect to said second plurality of apertures.

* * * * *